US005490496A

United States Patent [19]

Lin

[11] Patent Number: 5,490,496

[45] Date of Patent: Feb. 13, 1996

[54] ELECTRIC IGNITION TYPE HANDY GAS TORCH

[76] Inventor: Arlo H. T. Lin, No. 5, Lane 25, Tatung Rd., Wu Fong Hsiang, Taichung, Taiwan

[21] Appl. No.: 390,176

[22] Filed: Feb. 17, 1995

[51] Int. Cl.[6] ..... F23D 14/62

[52] U.S. Cl. ..... 126/414; 431/255; 431/254; 431/344

[58] Field of Search ..... 431/344, 255, 431/254, 12; 126/403, 404, 406, 407, 409, 413, 412, 414

[56] References Cited

U.S. PATENT DOCUMENTS

| | | | |
|---|---|---|---|
| 4,552,124 | 11/1985 | Nakajima | 126/413 |
| 4,688,551 | 8/1987 | Nakajima | 126/414 |
| 4,920,952 | 5/1990 | Nakajima | 126/414 |
| 5,135,389 | 8/1992 | Dai et al. | 126/403 X |

FOREIGN PATENT DOCUMENTS

| | | | |
|---|---|---|---|
| 2536181 | 2/1976 | Germany | 126/413 |

*Primary Examiner*—Carl D. Price
*Attorney, Agent, or Firm*—Pro-Techtor International

[57] ABSTRACT

An electronic ignition type handy gas torch wherein when the ignition switch is switched on to produce sparks, a sliding sleeve is moved forward to open a radial hole on the gas outlet tube, permitting air to mix with fuel gas within a slotted casing for burning behind the welding tip.

4 Claims, 4 Drawing Sheets

ELECTRIC IGNITION TYPE HANDY GAS TORCH

BACKGROUND OF THE INVENTION

The present invention relates to gas torches, and relates more particularly to an electronic ignition type handy gas torch which automatically opens the gas outlet tube to let air mix with fuel gas for combustion when the ignition switch is switched on.

Earlier gas torches, for example, the heat processing apparatus of U.S. Pat. No. 4,552,124 disclosed by NAKAZIMA TOKOSHO COMPANY of Japan, are operated to burn fuel gas by manual ignition. When gas container is opened to release fuel gas, a separate lighter is triggered to make a fire for burning fuel gas. Recently, electronic ignition devices are commonly used and installed in gas torch for producing sparks for igniting fuel gas. When fuel gas is released from the gas tube, it must be mixed with air so that a complete combustion can be achieved. According to conventional electronic ignition type gas torches, a lifting mechanism is installed and controlled to let air enter the casing of the apparatus for mixing with fuel gas when fuel gas is released from the gas container by means of the control of a rotary gas-release control knob. The installation of this lifting mechanism complicates the structure of the gas torch and its operation.

SUMMARY OF THE INVENTION

The present invention has been accomplished to provide an electronic ignition type handy gas torch which eliminates the aforesaid drawbacks. According to the preferred embodiment of the present invention, the ignition switch of the electronic igniter is controlled by a cap, which has a bottom coupling portion connected to a sliding sleeve on the gas outlet tube. When the cap is moved forwards to switch on the ignition switch, the sliding sleeve is simultaneously moved forward to open a radial hole on the gas outlet tube, permitting air to pass from the outside of the slotted casing of the gas torch through the sliding sleeve and to mix with fuel gas from the gas outlet tube within the slotted casing for burning behind the welding tip.

DETAILED DESCRIPTION OF THE PREFERRED EMBODIMENT

Figure 1:
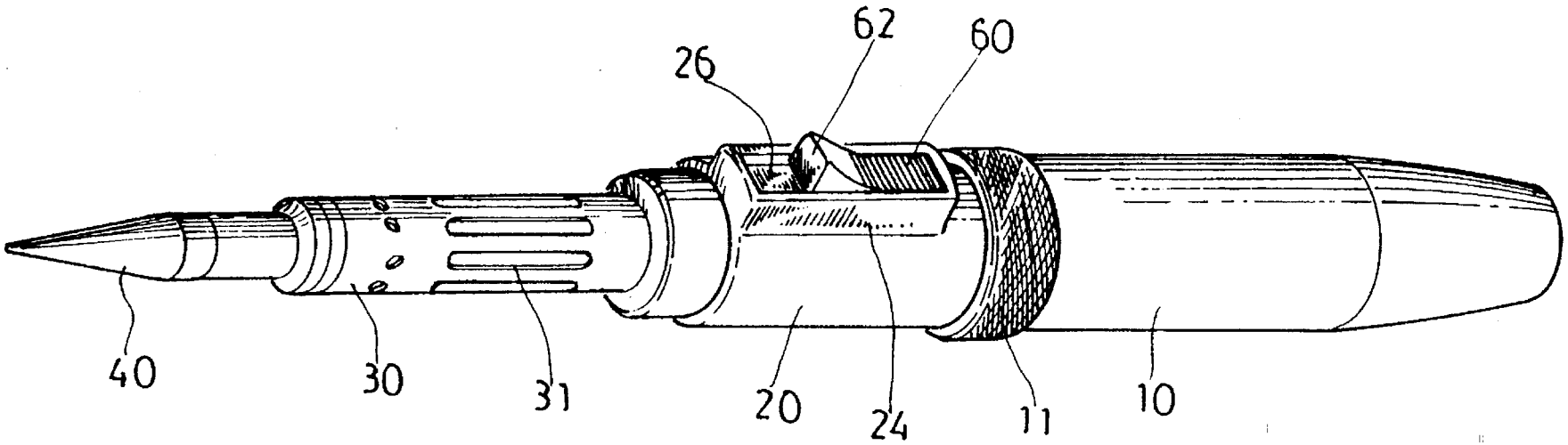
FIG. 1 is an elevational view of a gas torch according to the present invention.

Referring to FIG. 1, a handy gas torch in accordance with the present invention comprises a cylindrical gas container 10, a barrel 20, a rotary gas-control knob 11 connected between the gas container 10 and the barrel 20 and turned to open/close the fuel gas passage (not shown) between the gas container 10 and the barrel 20, a welding tip 40, and a cylindrical casing 30 connected between the barrel 20 and the welding tip 40 remote from the gas container 10.

Figure 2:
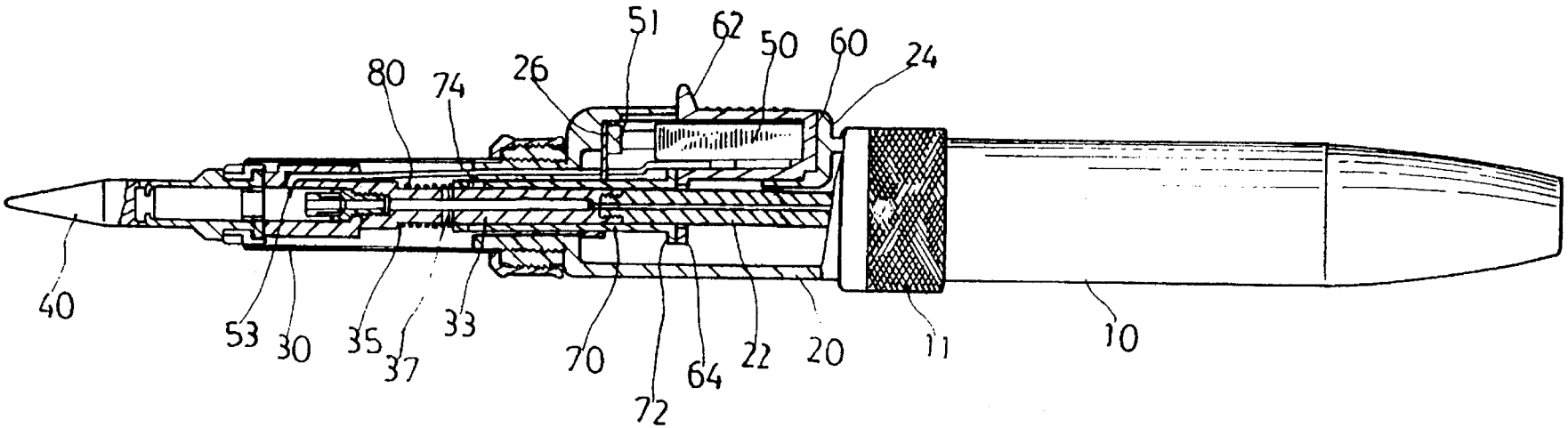
FIG. 2 is a longitudinal view in section of the gas torch shown in FIG. 1.
Figure 3:
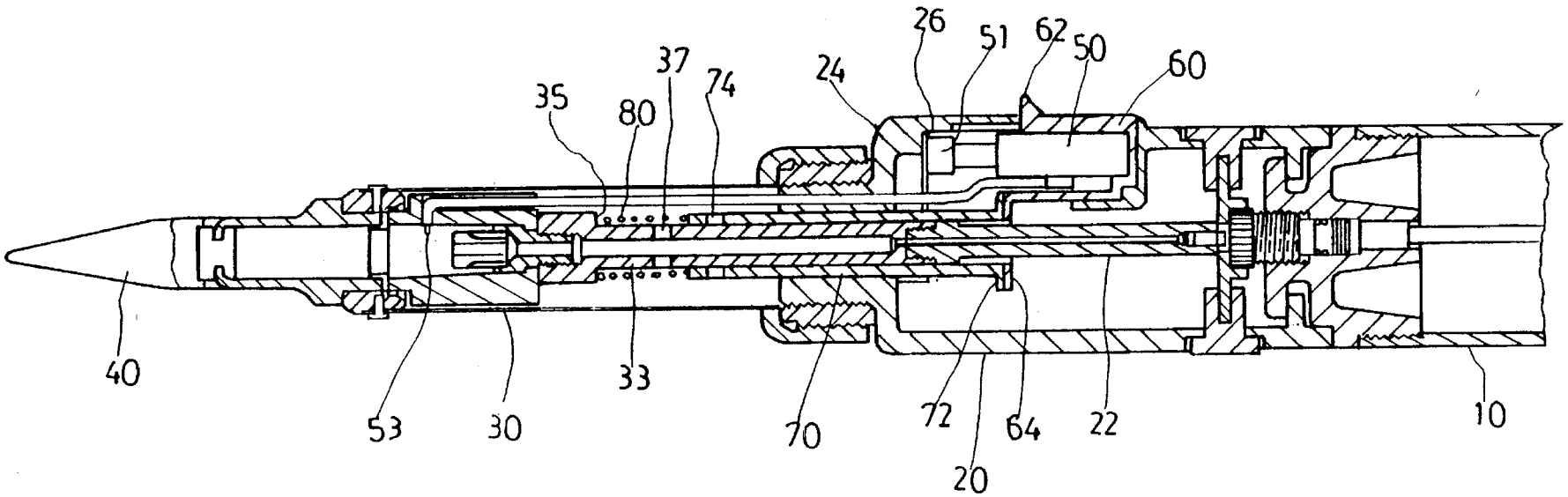
FIG. 3 is a partial view in an enlarged scale of FIG. 2, showing the position of the electronic ignition switch when closed.

Referring to FIGS. 2 and 3 and FIG. 1 again, the barrel 20 comprises a gas tube 22 longitudinally disposed on the inside and connected to the gas container 10 through the rotary gas-control knob 11, a hollow projecting block 24 of substantially rectangular shape raised from the outside wall, an electronic ignition switch 50 mounted within the hollow projecting block 24. The electronic ignition switch 50 has a press-control button 51 stopped at the inside wall 26 of the projecting block 24. A substantially U-shaped cap 60 is mounted within the hollow projecting block 24 and covered on the electronic ignition switch 50, having a projecting portion 62 extended outside the barrel 20 for moving by fingers and a bottom coupling portion 64 fastened to the gas tube 22. The casing 30 comprises a plurality of elongated air vents 31 spaced around the periphery, a gas outlet tube 33 having a rear end connected to the gas tube 22 and a front end terminating in a shoulder 35, a sliding sleeve 70 mounted around the gas outlet tube 33 and having an outward flange 72 at the rear end connected to the bottom coupling portion 64 of the cap 60, and a spring 80 mounted around the gas outlet tube 33 and stopped between the sliding sleeve 70 and the shoulder 35. The gas outlet tube 33 has a radial hole 37, through which air can be guided to mix with fuel gas for combustion. The sliding sleeve 70 has a radial hole 74 corresponding to the radial hole 37 on the gas outlet tube 33.

Referring to FIGS. 2 and 3 again, when the electronic ignition switch 50 is switched off, the radial hole 74 on the sliding sleeve 70 is not in alignment with the radial hole 37 on the gas outlet tube 33.

Figure 4:
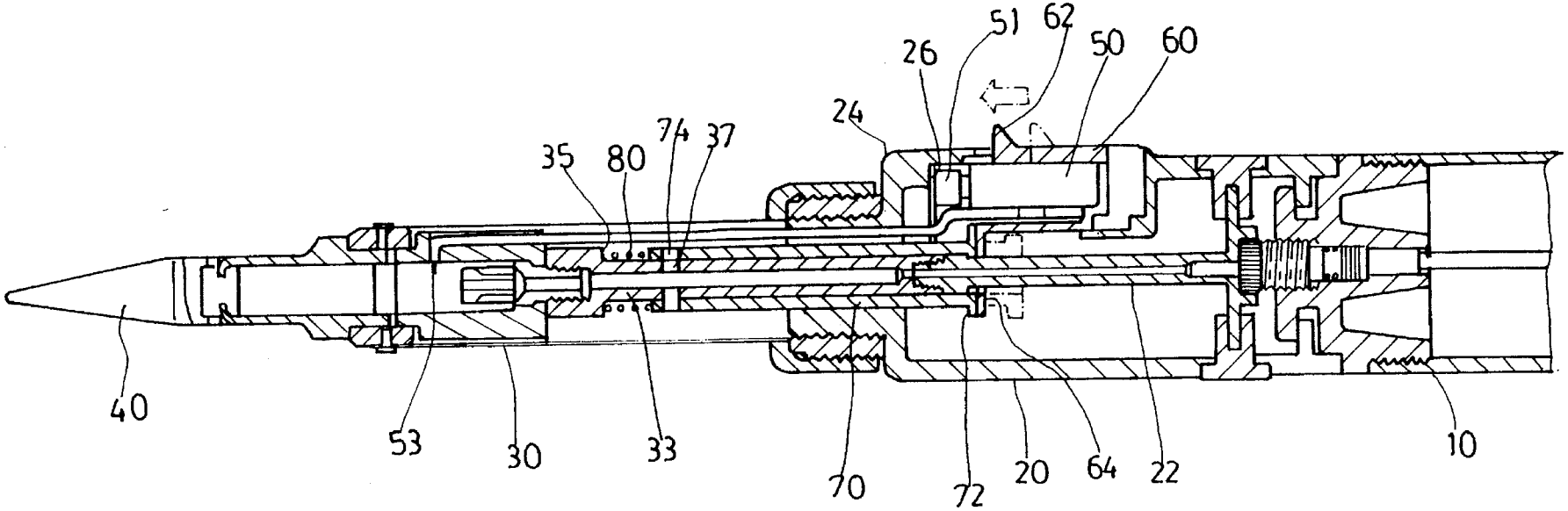
FIG. 4 is an enlarged view of FIG. 3, showing the position of the electronic ignition switch when opened.

Referring to FIG. 4, when the rotary gas-control knob 11 is turned on to release fuel gas from the gas container 10, the cap 60 is moved forwards in the direction of the arrow to switch on the electronic ignition switch 50, the front electrodes 53 are energized to produce sparks, at the same time the sliding sleeve 70 is moved forwards by the bottom coupling portion 64 of the cap 60 to align the radial hole 74 on the sliding sleeve 70 with the radial hole 37 on the gas outlet tube 33, permitting outside air to enter the gas outlet tube 33 and mix with fuel gas for burning by the sparks to heat the welding tip 40. When the cap 60 is released from the hand, the internal spring means (not shown) of the electronic ignition switch 50 and the spring 80 immediately force the electronic ignition switch 50 and the sliding sleeve 70 back to their former positions, causing the sliding sleeve 70 to close the radio hole 37 on the gas outlet tube 33.

While only one embodiment of the present invention has been shown and described, it will be understood that various modifications and changes could be made without departing from the spirit and scope of the invention.

What is claimed is:

1. A gas torch comprising a cylindrical gas container, a barrel having a hollow projecting block, a gas tube disposed inside said barrel, a rotary gas-control knob connected between said gas container and said barrel and controlled to release fuel gas from said gas container into said gas tube, a welding tip, a cylindrical casing connected between said barrel and said welding tip remote from said gas container and having elongated air vents, a gas outlet tube disposed inside said casing and connected to said gas tube and having a radial hole, an electronic ignition switch mounted within said hollow projecting block of said barrel and controlled to ignite fuel gas from said gas outlet tube for heating said welding tip, a cap mounted on said electronic ignition switch and arranged to be moved to switch on and off said electronic ignition switch and having a bottom coupling portion connected to said gas outlet tube, and a sliding sleeve mounted around said gas outlet tube and having a radial hole communicated with said air vents on said casing and arranged to be moved by said bottom coupling portion of said cap relative to the radial hole on said gas outlet tube, wherein when said cap is moved forward to switch on said electronic switch, said sliding sleeve is moved forward by said bottom coupling portion of said cap to align the radial hole on said sliding sleeve with the radial hole on said gas outlet tube, permitting fuel gas to be mixed with air for burning within said casing to heat said welding tip.

2. The gas torch of claim 1 further comprising spring means mounted on said gas outlet tube and stopped against one end of said sliding sleeve, said spring means being compressed by said sliding sleeve when said sliding sleeve is moved by said cap to align its radial hole with the radial hole on said gas outlet tube, said sliding sleeve automatically pushing said sliding sleeve back to its former position to close the radial hole on said gas outlet tube when said cap is released and said electronic ignition switch is switched off.

3. The gas torch of claim 1 wherein said sliding sleeve has an outward flange at a rear end thereof connected to said bottom coupling portion of said cap.

4. The gas torch of claim 1 wherein said electronic ignition switch has a press-control button stopped at an inside wall of said hollow projecting block of said barrel.

* * * * *